US007156653B1

(12) United States Patent
DeMars

(10) Patent No.: US 7,156,653 B1
(45) Date of Patent: Jan. 2, 2007

(54) TORCH ASSEMBLY WITH WICK CAP AND FUNNEL

(75) Inventor: Robert DeMars, Woodland Hills, CA (US)

(73) Assignee: Original Ideas, Inc, La Quinta, CA (US)

( * ) Notice: Subject to any disclaimer, the term of this patent is extended or adjusted under 35 U.S.C. 154(b) by 0 days.

(21) Appl. No.: 11/294,109

(22) Filed: Dec. 6, 2005

(51) Int. Cl.
*F23D 3/24* (2006.01)

(52) U.S. Cl. ..... 431/321; 431/344; 431/324

(58) Field of Classification Search ..... 431/320–324, 431/344, 343, 319, 298, 253, 142, 143; 248/94; 126/403, 407, 404
See application file for complete search history.

(56) References Cited

U.S. PATENT DOCUMENTS

| | | | | |
|---|---|---|---|---|
| 2,143,495 | A * | 1/1939 | Nier | 431/301 |
| 3,994,672 | A | 11/1976 | Novak | |
| 4,025,280 | A | 5/1977 | Wilson | |
| 4,035,138 | A | 7/1977 | Walters | |
| 4,126,408 | A | 11/1978 | Cox | |
| 4,153,172 | A * | 5/1979 | Bialobrzeski | 215/209 |
| 4,477,247 | A * | 10/1984 | Kumasaka | 431/146 |
| 4,494,926 | A | 1/1985 | Riha | |
| 4,511,952 | A | 4/1985 | Vanbragt | |
| 4,689,727 | A | 8/1987 | Perkins | |
| 4,728,286 | A | 3/1988 | Olsen | |
| 5,163,879 | A | 11/1992 | Black | |
| 5,205,730 | A * | 4/1993 | Capdeville | 431/320 |
| 5,256,059 | A | 10/1993 | Knippenberg | |
| 5,547,371 | A * | 8/1996 | Rose | 431/320 |
| 5,743,505 | A * | 4/1998 | Sofy | 248/346.01 |
| 5,807,093 | A | 9/1998 | Tendick, Sr. | |
| 5,928,539 | A * | 7/1999 | Thivet | 219/267 |
| 5,938,430 | A * | 8/1999 | Majerowski | 431/320 |
| 6,250,912 | B1 | 6/2001 | Widdowson | |
| 6,345,978 | B1 | 2/2002 | Lu | |
| 6,399,028 | B1 | 6/2002 | Huang | |
| 6,426,051 | B1 | 7/2002 | Allison | |
| 6,514,070 | B1 | 2/2003 | Lu | |
| 6,579,090 | B1 | 6/2003 | Taubitz et al. | |
| 6,886,959 | B1 | 5/2005 | Record | |
| 6,905,330 | B1 | 6/2005 | Ohlin | |

* cited by examiner

*Primary Examiner*—Josiah C. Cocks
*Assistant Examiner*—Chuka C Ndubizu
(74) *Attorney, Agent, or Firm*—Dan M. DeLaRosa

(57) ABSTRACT

A torch assembly is provided, the assembly comprising: a container comprising an internal chamber for holding liquid fuel and an opening leading to the chamber; a wick having opposing ends, the first end is inserted through the opening and situated within the chamber, the second end projecting outwardly from the opening; a wick cap attached to the second end of the wick; a wick rod attached to the first end of the wick, the rod designed to be situated within the chamber of the container; and a snuffer cap designed to be attachable and detachable from the wick cap.

16 Claims, 7 Drawing Sheets

TORCH ASSEMBLY WITH WICK CAP AND FUNNEL

BACKGROUND OF THE INVENTION

1. Field of the Invention

This invention relates to a liquid fuel torch assembly and more particularly, a liquid fuel burning torch system including a wick cap and funnel for loading the torch assembly container with liquid fuel.

2. Description of the Related Art

Torches of this type are present in the marketplace and are known, including outdoor tropical luau or garden torches. In conventional torch designs, there is a barrel-shaped container that holds the liquid fuel and has a socket-shaped mounting portion extending downwardly from the bottom wall of the container, and a fling neck situated on the top wall of the container and having a filling opening. Then, a substantially cup-shaped closing member is removably mounted on the filling neck and has a central opening through which a wick extends from the interior to the exterior of the container. When the closing member is removed from the filling neck, an original or replacement wick can be inserted into the central opening of the closing member, so that the closing member functions as a support for the wick. During a filling stage, the liquid fuel is poured into the internal chamber of the container through the filling neck. Then, the closing member is slid over the filling neck while the wick is simultaneously introduced through the opening of the filling neck into the interior of the container. Once this procedure is accomplished and the length of the wick sticking out of the aperture of the closing member is adjusted as desired, the torch is ready to be lit.

The conventional torch also includes a snuffer cap, which is designed to extinguish the flame when the operation of the torch is discontinued. This snuffer cap is so dimensioned that it can be easily slid over the covering member and will then substantially prevent access of atmospheric oxygen to the flame or to the portion of the wick which extends upwardly of the closing member. Thus, the flame will be extinguished, and excessive evaporation of the liquid fuel from the wick is avoided so long as the snuffer cap is present on and around the closing member. The snuffer cap can also have an attachment device for connecting the snuffer cap and the container.

The major problem with conventional torches is the filling procedure and the contact with the wick during the filling process. During the filling process, the wick must be removed and the liquid fuel is then poured into the filling neck. Users would like to avoid contact with the wick because it is messy and filled with the liquid fuel. The present invention provides for a torch assembly that addresses these and other problems.

SUMMARY OF THE INVENTION

In one embodiment, the present invention provides for a torch assembly comprising: a container comprising an internal chamber for holding liquid fuel and an opening leading to the chamber; a wick having opposing ends, the first end is inserted through the opening and situated within the chamber, the second end projecting outwardly from the opening; a wick cap attached to the second end of the wick; a wick rod attached to the first end of the wick, the rod designed to be situated within the chamber of the container; and a snuffer cap designed to be attachable and detachable from the wick cap.

In another embodiment, the torch assembly further comprises a funnel, the funnel comprises an opening leading to a narrow tube, the tube is designed to fit within the opening of the container during a filling stage and the container designed to sit upon the opening of the funnel during usage and storage. In still another embodiment, the wick cap comprises threads designed to rotatably fit with the snuffer cap and at least one spring clip, the spring clip designed to fit within the opening of the container.

In yet another embodiment, the opening of the container comprises at least two detents, the wick cap comprises at least two spring clips, each of the spring clips designed to snap fit into the detents of the opening of the container. In still yet another embodiment, the snuffer cap of the torch assembly further comprises a connector for attaching the snuffer cap to the container.

In a further embodiment, during a filling stage, the snuffer cap is attached to the wick cap while the wick cap is attached to one end of the wick (the end projecting from the opening of the container) and the rod is attached to the other end of the wick (which is situated within the chamber of the container). The wick is pulled outwardly and away from the opening to allow for filling of the container and the rod prevents the entire wick from being removed from the internal chamber of the container. In another further embodiment, the torch assembly of the present invention further comprises a funnel with an opening leading to a narrow tube, and the narrow tube is designed to fit within the opening of the container during the filling stage.

In yet a further embodiment, the torch assembly further comprises an upright post, the post having opposing ends, a first end having an opening, the narrow tube of the funnel is designed to fit within the opening of the post, the container is designed to sit upon the opening of the funnel during usage and storage. The second end of the post is designed to be attached to a stand or is designed to be inserted into the ground.

In another further embodiment, the present invention provides for a torch assembly comprising: a container comprising a internal chamber for holding liquid fuel and an opening leading to the chamber; an elongated wick having opposing ends, the first end being inserted through the opening and situated within the chamber, the second end projecting outwardly from the opening, a majority of the elongated wick being situated within the chamber during usage; a wick cap attached to the second end of the wick; and a snuffer cap designed to be attachable and detachable from the wick cap, the snuffer cap being attached to the wick cap during a filling stage to allow a user to pull a majority of the wick outwardly and away from the opening of the container to allow for filling of the container with liquid fuel.

In still another further embodiment, the torch assembly further comprises a funnel, the funnel having an opening leading to a narrow tube, the narrow tube is designed to fit within the opening of the container during the filling stage.

In yet another further embodiment, the wick cap comprises at least one spring clip for attaching the wick cap to the opening of the container and prevents the wicker cap from rotating when unscrewing the snuffer cap. In still yet another further embodiment, the opening of the container comprises at least one detent for engaging the spring clip of the wick cap to attach the wick cap to the container during usage and storage.

In another embodiment, the torch assembly further comprises a wick rod attached to the first end of the wick, the rod is designed to be situated within the chamber of the container and prevent the wick from being completely removed from the chamber during the filling stage. In a further embodiment, the snuffer cap further comprises a connector for attaching the snuffer cap to the container.

In yet another embodiment, the torch assembly further comprises an upright post, the post having opposing ends, a first end having opening, the narrow tube of the funnel is designed to fit within the opening of the post, the container is designed to sit upon the opening of the funnel during usage and storage.

In still another embodiment, the torch assembly system of the present invention comprises: a container comprising an internal chamber for holding liquid fuel and an opening leading to the chamber; a wick having opposing ends, the first end is inserted through the opening and situated within the chamber, the second end projecting outwardly from the opening; a wick cap attached to the second end of the wick; a wick rod attached to the first end of the wick, the rod designed to be situated within the chamber of the container; a snuffer cap designed to be attachable and detachable from the wick cap; and a funnel comprising an opening leading to a narrow tube, the tube being designed to fit within the opening of the container during a filling stage and the container designed to sit upon the opening of the funnel during usage and storage. In another embodiment, the length of the wick rod is longer than the diameter of the opening of the container.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Figure 1:
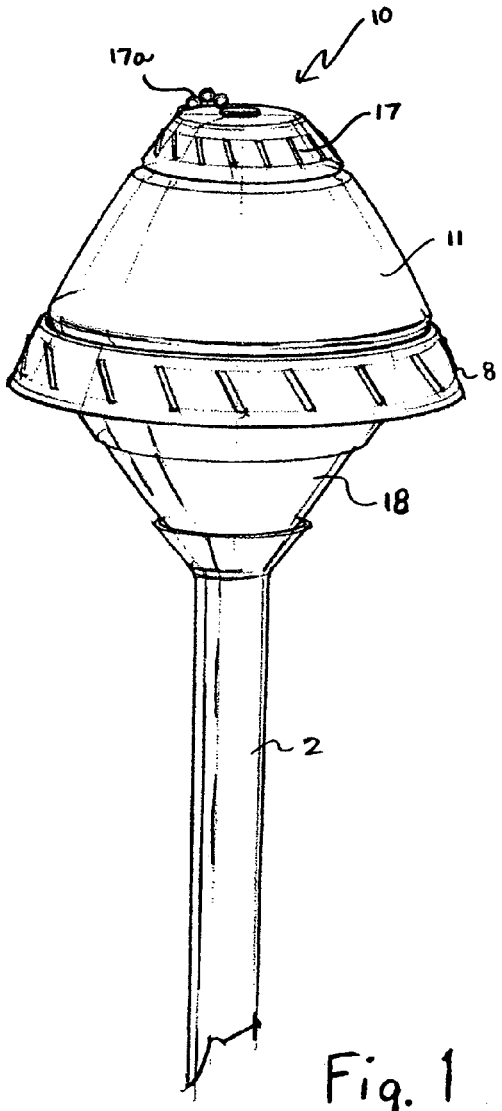
FIG. 1 is a perspective view of one of the embodiments of the torch assembly of the present invention showing the snuffer cap attached the container in a non-use stage.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessary to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Referring now to FIGS. 1–4, one embodiment of the torch assembly 10 of the present invention is shown. The torch assembly 10 comprises: a container 11 having an internal chamber 12 for holding liquid fuel and an opening 13 leading to the chamber 12; a wick 14 having opposing ends, 14*a* and 14*b* respectively. The first end 14*a* of the wick 14 is inserted through the opening 13 and situated within the chamber 12. The second end 14*b* of the wick 14 projects outwardly from the opening 13 of the container 11. The torch assembly 10 further comprises a wick cap 15, which is attached to the second end 14*b* of the wick 14 and a wick rod 16, which is attached to the first end 14*a* of the wick 14. The rod 16 is situated within the chamber 12 of the container 11. The torch assembly also has a snuffer cap 17 designed to be attachable and detachable from the wick cap 15.

Figure 2:
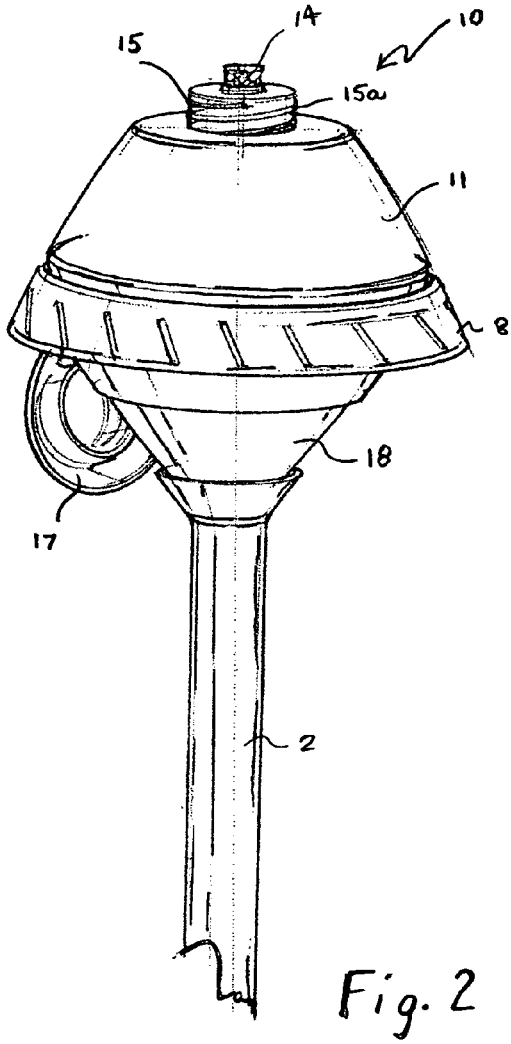
FIG. 2 is a perspective view of FIG. 1 with the torch assembly in use showing a flame and the snuffer cap detached from the container.

The torch assembly also comprises a funnel 18. The funnel 18 has an opening 18*a* leading to a narrow tube 18*b*; the tube 18*b* is designed to fit within the opening 13 of the container 11 during a filling stage and the container 11 is designed to sit upon the opening 18*a* of said funnel 18 during usage and storage (as shown in FIGS. 1–2).

The wick cap 15 of the torch assembly 10 comprises threads 15*a* designed to rotatably fit with the snuffer cap 17 and at least one spring clip 19. The spring clip 19 is designed to fit within the opening 13 of the container 11.

Figure 3:
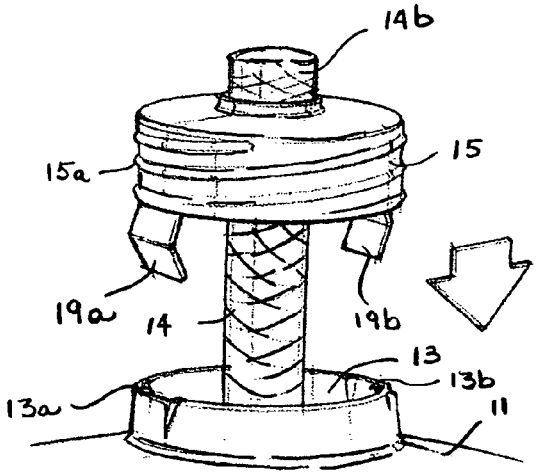
FIG. 3 is a perspective view of wick cap of FIG. 1 and how it attached to the detents of the opening of the container.
Figure 4:
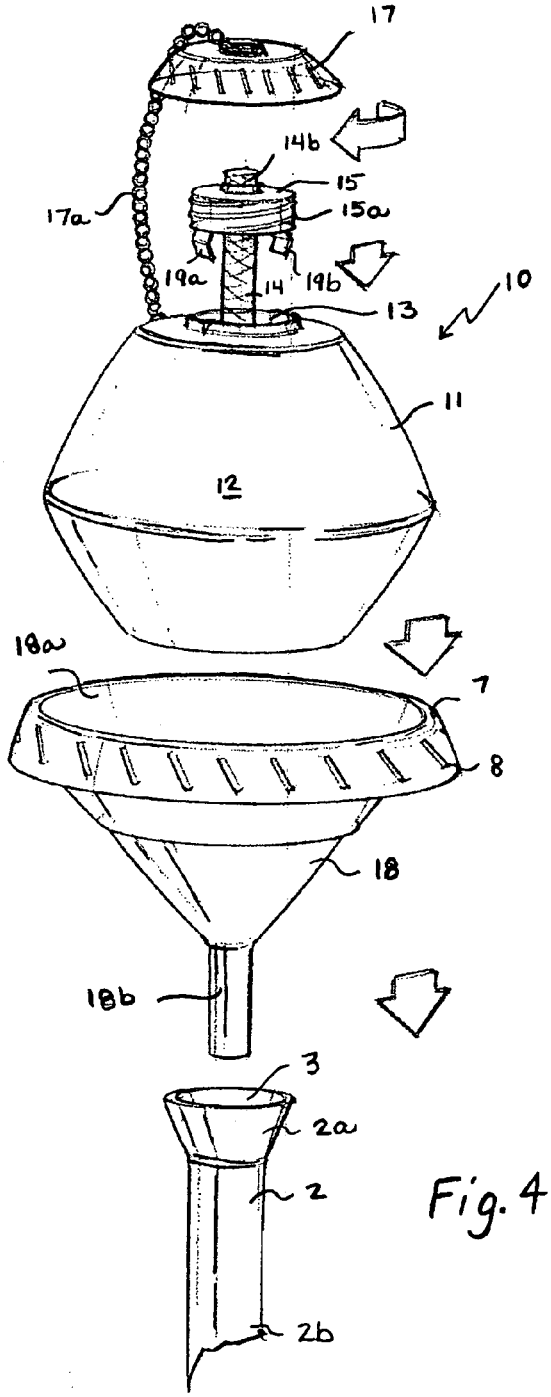
FIG. 4 is a perspective view of FIG. 1 showing the components of the torch assembly including the container with wick and wick cap, snuffer cap, funnel and post.

The opening 13 of the container 11 comprises at least two detents, 13*a* and 13*b* respectively. The wick cap 15 comprises at least two spring clips, 19*a* and 19*b* respectively, each of the spring clips is designed to snap fit into the detents 13*a* and 13*b*, of the opening 13 of the container 11 (as shown in FIG. 3). The snuffer cap 17 of the torch assembly 10 further comprises a connector 17*a* for attaching the snuffer cap 17 to the container 11 (as shown in FIG. 4).

The torch assembly 10 further comprises an upright post 2, the post having opposing ends, 2*a* and 2*b* respectively; the first end 2*a* having opening 3 and the narrow tube 18*b* of the funnel 18 is designed to fit within the opening 3 of the post 2. The container 11 is designed to sit upon the opening 13 of the funnel 18 during usage and storage.

In FIGS. 1–4, the container 11 of the torch assembly 10 of the present invention has a barrel-shape and the funnel 18 has a peripheral edge 7 extending to a lip 8; the edge 7 being situated around the opening 18*a* of the funnel 18.

Referring now to FIGS. 5–8, another embodiment of the torch assembly 20 of the present invention is shown. The torch assembly 20 comprises: a container 21 having an internal chamber 22 for holding liquid fuel and an opening 23 leading to the chamber 22; a wick 24 having opposing ends, 24*a* and 24*b* respectively. The first end 24*a* of the wick 24 is inserted through the opening 23 and situated within the chamber 22. The second end 24*b* of the wick 24 projects outwardly from the opening 23 of the container 21. The torch assembly 20 further comprises a wick cap 25, which is attached to the second end 24*b* of the wick 24 and a wick rod 26, which is attached to the first end 24*a* of the wick 24. The rod 26 is situated within the chamber 22 of the container 21. The torch assembly also has a snuffer cap 27 designed to be attachable and detachable from the wick cap 25.

Figure 5:
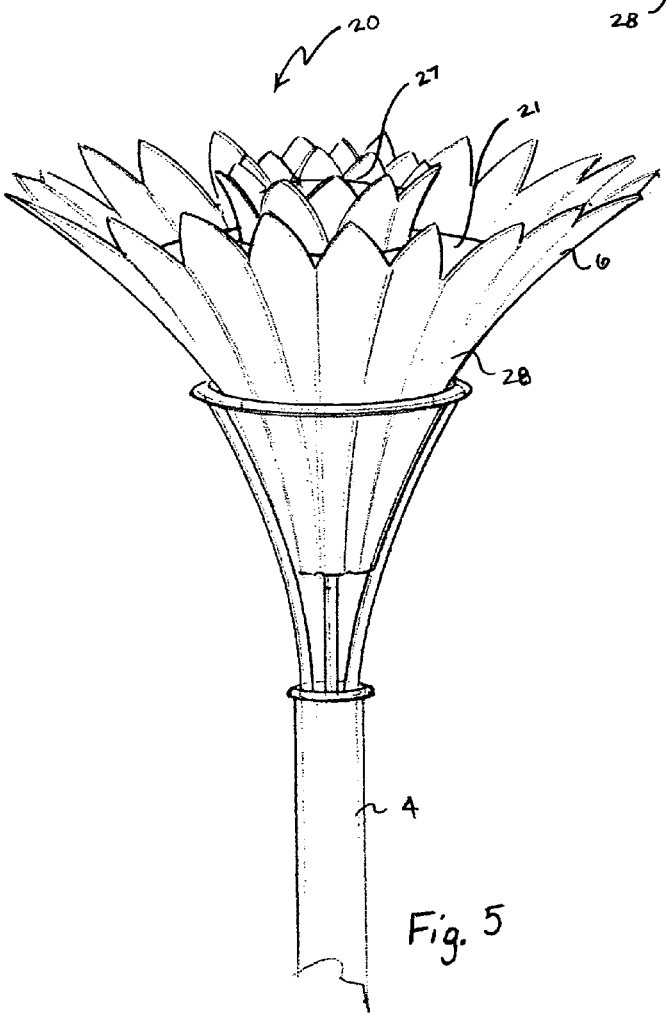
FIG. 5 is a perspective of another embodiment of the torch assembly of the present invention in a non-use stage.
Figure 6:
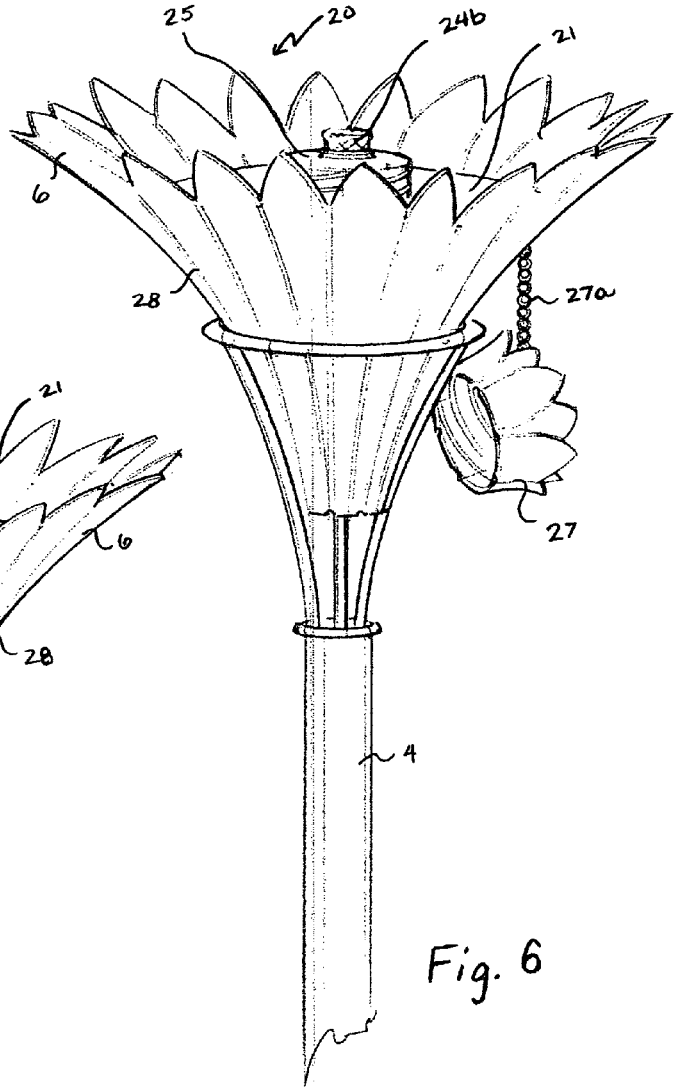
FIG. 6 is a perspective view of FIG. 5 with the torch assembly in use showing a flame and the snuffer cap detached from the container.

The torch assembly also comprises a funnel 28. The funnel 28 has an opening 28*a* leading to a narrow tube 28*b*; the tube 28*b* is designed to fit within the opening 23 of the container 21 during a filling stage and the container 21 is designed to sit upon the opening 28*a* of said funnel 28 during usage and storage (as shown in FIGS. 5–6).

Figure 7:
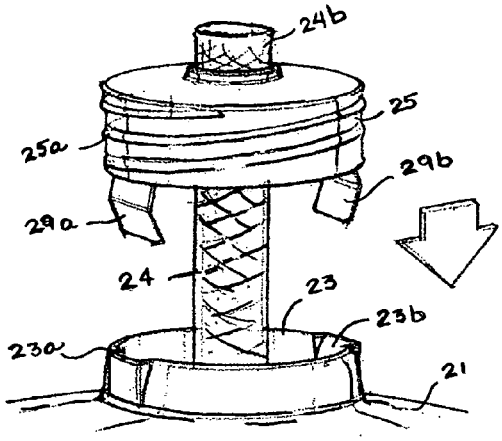
FIG. 7 is a perspective view of wick cap of FIG. 5 and how it attached to the detents of the opening of the container.
Figure 8:
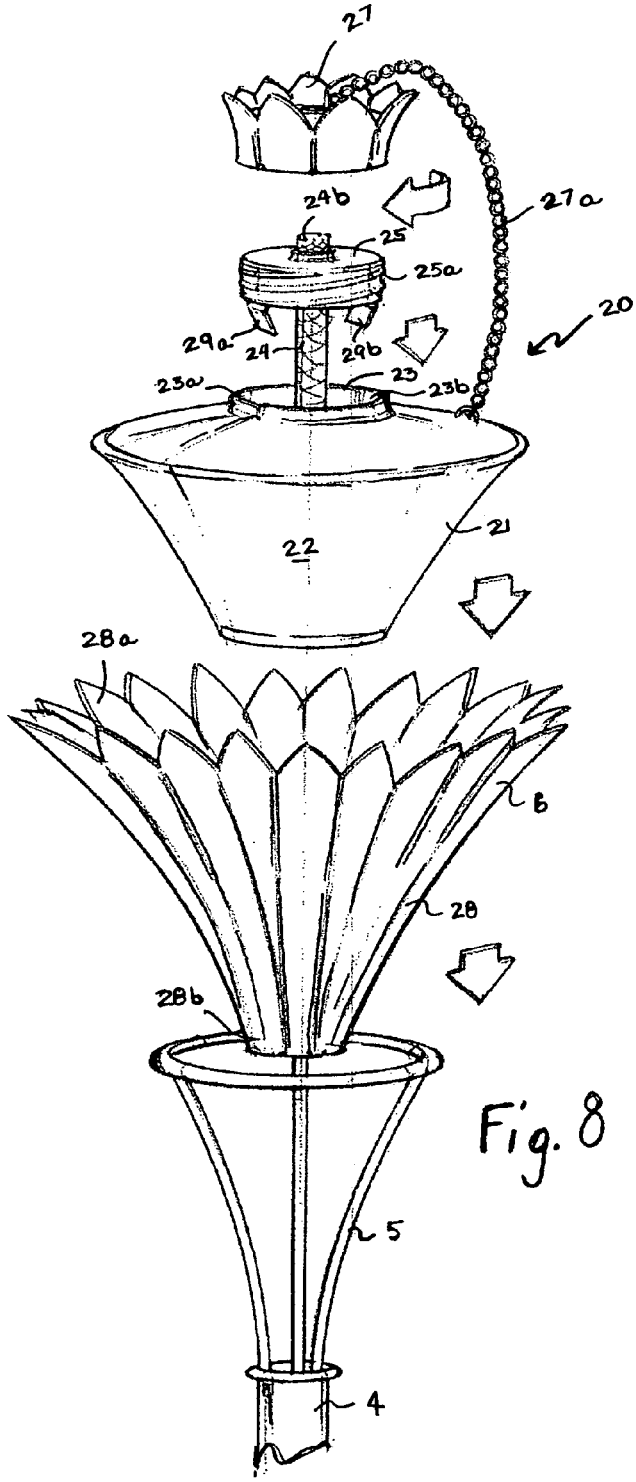
FIG. 8 is a perspective view of FIG. 5 showing the components of the torch assembly including the container with wick and wick cap, snuffer cap, funnel and post.

The opening 23 of the container 21 comprises at least two detents, 23*a* and 23*b* respectively. The wick cap 25 comprises at least two spring clips, 29*a* and 29*b* respectively, each of the spring clips is designed to snap fit into the detents 23*a* and 23*b*, of the opening 23 of the container 21 (as shown in FIG. 7). The snuffer cap 27 of the torch assembly 20 further comprises a connector 27*a* for attaching the snuffer cap 27 to the container 21 (as shown in FIG. 8).

The torch assembly 20 further comprises an upright post 4, the post having opposing ends, 4*a* and 4*b* respectively; the first end 4*a* having an extended portion 5 and the narrow tube 28*b* of the funnel 28 is designed to sit upon the extended portion 5 of the post 4. The container 21 is designed to sit upon the opening 23 of the funnel 28 during usage and storage.

In FIGS. 5–8, the container 21 of the torch assembly 20 of the present invention is substantially v-shaped and the funnel 28 has a plurality of connected leaf-like components 6 with pointed tips at its top end. The container 21 sits within the funnel 28 and is substantially covered by the pointed tips of the components 6 with the wick 24 showing at the top end of the funnel 28.

Referring now to FIGS. 9–12, another embodiment of the torch assembly 30 of the present invention is shown. The torch assembly 30 comprises: a container 31 having an internal chamber 32 for holding liquid fuel and an opening 33 leading to the chamber 32; a wick 34 having opposing ends, 34*a* and 34*b* respectively. The first end 34*a* of the wick 34 is inserted through the opening 33 and situated within the chamber 32. The second end 34*b* of the wick 34 projects outwardly from the opening 33 of the container 31. The torch assembly 30 further comprises a wick cap 35, which is attached to the second end 34*b* of the wick 34 and a wick rod 36, which is attached to the first end 34*a* of the wick 34. The rod 36 is situated within the chamber 32 of the container 31. The torch assembly also has a snuffer cap 37 designed to be attachable and detachable from the wick cap 35.

Figure 9:
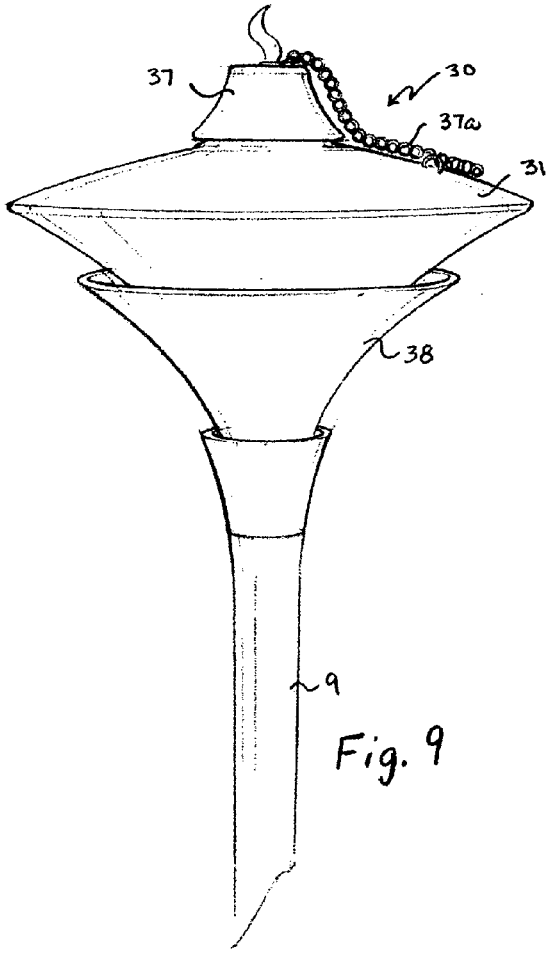
FIG. 9 is a perspective of another embodiment of the torch assembly of the present invention in a non-use stage.
Figure 10:
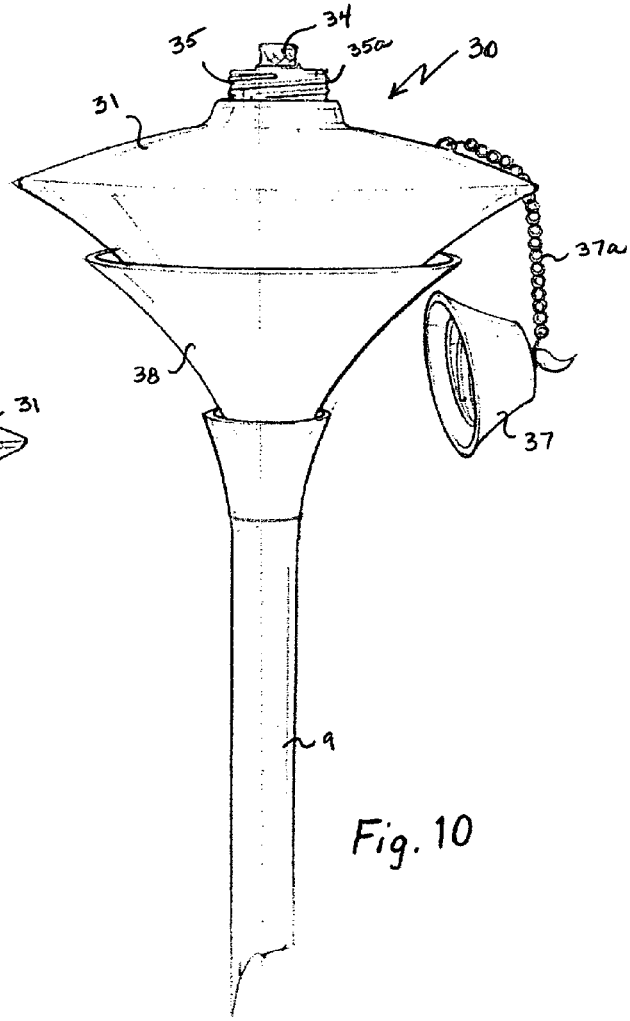
FIG. 10 is a perspective view of FIG. 9 with the torch assembly in use showing a flame and the snuffer cap detached from the container.

The torch assembly also comprises a funnel 38. The funnel 38 has an opening 38*a* leading to a narrow tube 38*b*; the tube 38*b* is designed to fit within the opening 33 of the container 31 during a filling stage and the container 31 is designed to sit upon the opening 38*a* of said funnel 38 during usage and storage (as shown in FIGS. 9–10).

Figure 11:
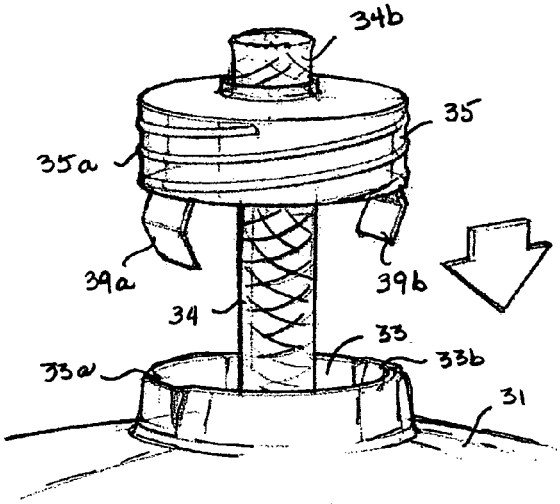
FIG. 11 is a perspective view of wick cap of FIG. 9 and how it attached to the detents of the opening of the container.
Figure 12:
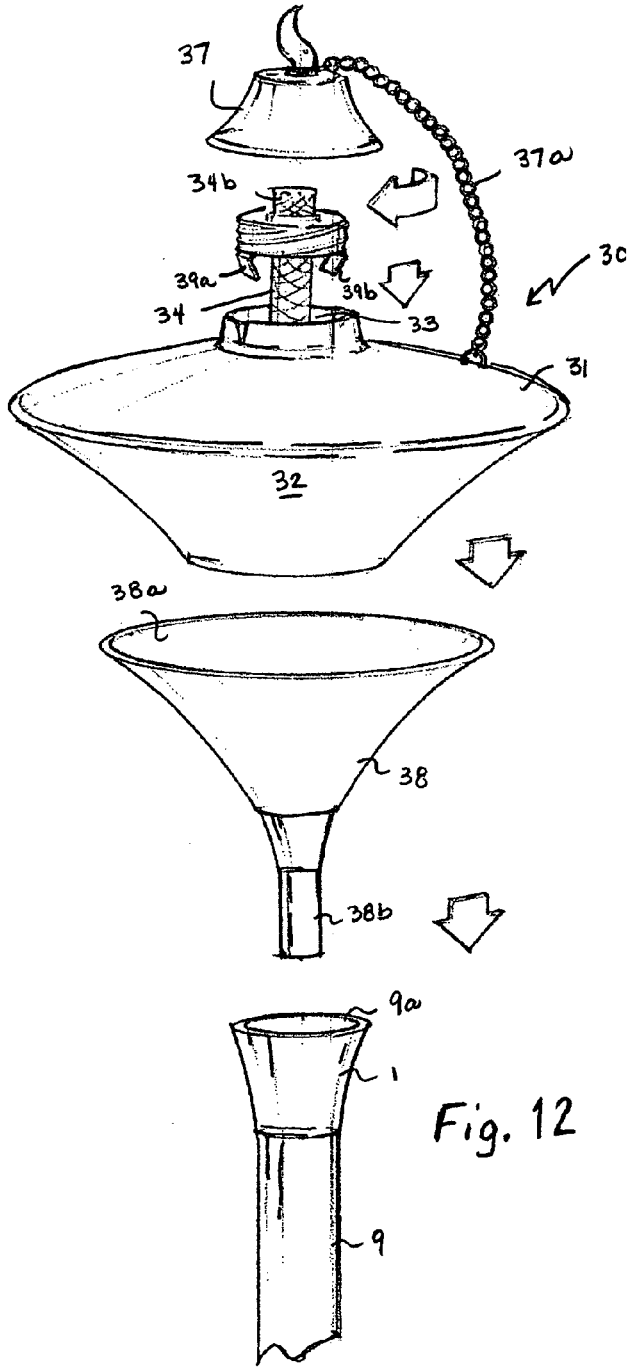
FIG. 12 is a perspective view of FIG. 9 showing the components of the torch assembly including the container with wick and wick cap, snuffer cap, funnel and post.

The opening 33 of the container 31 comprises at least two detents, 33*a* and 33*b* respectively. The wick cap 35 comprises at least two spring clips, 39*a* and 39*b* respectively, each of the spring clips is designed to snap fit into the detents 33*a* and 33*b*, of the opening 33 of the container 31 (as shown in FIG. 11). The snuffer cap 37 of the torch assembly 30 further comprises a connector 37*a* for attaching the snuffer cap 37 to the container 31 (as shown in FIG. 12).

The torch assembly 30 further comprises an upright post 9, the post having opposing ends, 9*a* and 9*b* respectively; the first end 9*a* having an extended portion 1 and the narrow tube 38*b* of the funnel 38 is designed to sit upon the extended portion 1 of the post 9. The container 31 is designed to sit upon the opening 33 of the funnel 38 during usage and storage.

In FIGS. 9–12, the container 31 of the torch assembly 30 of the present invention has a top and bottom portion, 31*a* and 31*b* respectively; the bottom portion 31*b* of the container 31 is predominantly V-shaped and the funnel 38 has a V-shape.

Figure 13:
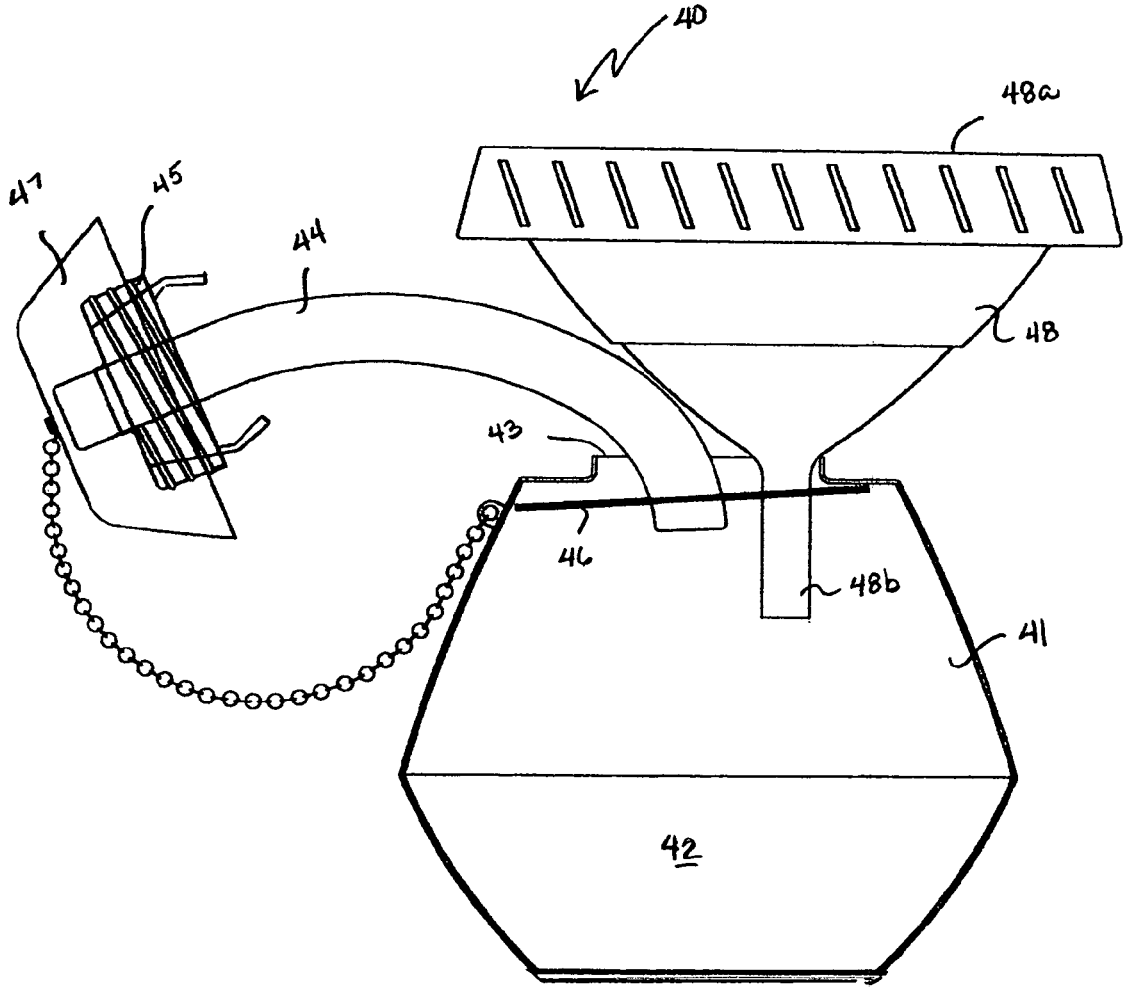
FIG. 13 is a cross-sectional view showing how the container of the torch assembly of the present invention is filled with liquid fuel.

Referring now to FIG. 13, the method of how the container 41 of the torch assembly 40 is filled with liquid fuel is shown. During a filling stage, the snuffer cap 47 is attached to the wick cap 45 and the wick cap 45 with the wick 44; the wick cap 45 is pulled outwardly and away from the opening 43 to allow for filling of the container 41 while the wick rod 46 prevents the entire wick 44 from completely exiting the opening 43 of the container 41. The narrow tube 48*b* of the funnel 48 is inserted into the opening 43 of the container 41. Liquid fuel is then poured into the opening 48*a* of the funnel 48, then goes through the inside of the narrow tube 48*b* and enters the container 41 and is retained in the internal chamber 42.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A torch assembly comprising:

a container comprising an internal chamber for holding liquid fuel and an opening leading to said chamber, said opening having at least one detent;

a wick having opposing ends, said first end being inserted through said opening and situated within said chamber, said second end projecting outwardly from said opening;

a removable wick cap attached to said second end of said wick, said wick cap comprising at least one spring clip, said spring clip designed to fit with said detent of said opening of said container and secure said wick cap to said container;

a funnel comprising an upper portion having an opening leading to a lower portion with a tube, said upper portion having an inside diameter capable of supporting said container, said tube being designed to fit within said opening of said container during a filling stage and said container designed to sit upon said upper portion of said funnel during usage and storage; and a wick rod attached to said first end of said wick, said rod designed to be situated within said chamber of said container, said wick rod having a length longer than a diameter of said opening of said container to thereby prevent said wick rod from being removed from said chamber of said container, during a filling stage, said wick cap being removed from said container thereby allowing access for said narrow tube of said funnel to enter said opening of said container and said wick rod having a width that allows access to said opening of said container for filling said container with liquid fuel.

2. The torch assembly of claim 1 further comprising a snuffer cap, said wick cap comprises threads designed to rotatably fit with said snuffer cap.

3. The torch assembly of claim 2 wherein said snuffer cap further comprises a connector for attaching said snuffer cap to said container.

4. The torch assembly of claim 2 wherein, during a filling stage, said snuffer cap is attached to said wick cap which is attached to said wick and said snuffer cap is pulled outwardly and away from said opening thereby moving a majority of said wick out of said chamber to allow for filling of said container with liquid fuel and said wick rod prevents said entire wick from exiting said opening of said container.

5. The torch assembly of claim 1 further comprises an upright post, said post having opposing ends, a first upper end having an opening, said tube of said funnel being designed to fit within said opening of said upper end of said post, said container being designed to sit upon said upper end of said funnel during usage and storage.

6. A torch assembly comprising:

a container comprising an internal chamber for holding liquid fuel and an opening leading to said chamber, said opening having at least one detent;

an elongated wick having opposing ends, said first end being inserted through said opening and situated within said chamber, said second end projecting outwardly from said opening, a majority of said elongated wick being situated within said chamber during usage;

a removable wick cap attached to said second end of said wick, said wick cap comprising at least one spring clip, said spring clip designed to fit with said detent of said opening of said container and secure said wick cap to said container;

a wick rod attached to said first end of said wick, said rod designed to be situated within said chamber of said container, said wick rod having a length longer than the diameter of said opening of said container to thereby prevent said wick rod from being removed from said chamber of said container; and a snuffer cap designed to be attachable and detachable from said wick cap, said snuffer cap being attached to said wick cap and said wick cap being removed from said container and said wick rod having a width that allows access to said opening during a filling stage to allow a user to pull a majority of said wick outwardly and away from said opening of said container while said wick rod stays within said chamber to allow for filling of said container with liquid fuel.

7. The torch assembly of claim 6 further comprises a removable funnel, said funnel having an upper portion with an opening leading to lower portion with a tube, said upper portion having an inside diameter capable of supporting said container, said tube is designed to fit within said opening of said container during said filling stage and said container designed to sit upon said upper portion of said funnel during usage and storage.

8. The torch assembly of claim 6 wherein said snuffer cap further comprises a connector for attaching said snuffer cap to said container.

9. The torch assembly of claim 7 further comprises an upright post, said post having opposing ends, a first upper end having an opening, said tube of said funnel being designed to fit within said opening of said upper end of said post, said container being designed to sit upon said upper end of said funnel during usage and storage.

10. A torch assembly system comprising:

a container comprising an internal chamber for holding liquid fuel and an opening leading to said chamber;

a wick having opposing ends, said first end being inserted through said opening and situated within said chamber, said second end projecting outwardly from said opening;

a wick cap attached to said second end of said wick, said wick cap is capable of being connected to said opening of said container and being removeable from said container;

a wick rod attached to said first end of said wick, said rod designed to be situated within said chamber of said container, said wick rod having a length longer than the a diameter of said opening of said container to thereby prevent said wick rod from being removed from said chamber of said container; and a removable funnel comprising an upper portion having an opening leading to a lower portion with a tube, said upper portion having an inside diameter capable of supporting said container, during a filling stage, said wick cap being removed from said container thereby allowing access to said opening of said container and said wick rod allowing at least a portion of said wick to be situated within said chamber while allowing access to said opening of said container for filling said container with liquid fuel, said tube of said funnel being designed to fit within said opening of said container during a filling stage and said container designed to sit upon said opening of said funnel during usage and storage.

11. The torch assembly of claim 10 further comprises a snuffer cap, during a filling stage, said snuffer cap is attached to said wick cap and whereby said snuffer cap with said wick cap and said wick are pulled outwardly and away from said opening to allow for filling of said container.

12. The torch assembly of claim 11 wherein said container is separated from said funnel and then said tube of said funnel is inserted within said opening of said container during said filling stage.

13. The torch assembly of claim 10 wherein said snuffer cap further comprises a connector for attaching said snuffer cap to said container.

14. The torch assembly of claim 10 further comprises an upright post, said post having opposing ends, a first upper end having an opening, said tube of said funnel being designed to fit within said opening of said upper end of said post, said container being designed to sit upon said upper end of said funnel during usage and storage.

15. The torch assembly of claim 10 wherein said opening of said container comprises at least one detents, said wick cap comprises at least one spring clips, said spring clip designed to snap fit into said detents of said opening of said container to thereby secure said wick cap to said container.

16. The torch assembly of claim 10 wherein said opening of said container comprises at least two detents, said wick cap comprises at least two spring clips, each of said spring clip designed to snap fit into said detents of said opening of said container to thereby secure said wick cap to said container.

* * * * *